US009170589B2

(12) United States Patent
Georgescu

(10) Patent No.: US 9,170,589 B2
(45) Date of Patent: Oct. 27, 2015

(54) FULLY INTEGRATED ADJUSTABLE DC CURRENT REFERENCE BASED ON AN INTEGRATED INDUCTOR REFERENCE

(71) Applicant: Bogdan Alexandru Georgescu, Calgary (CA)

(72) Inventor: Bogdan Alexandru Georgescu, Calgary (CA)

( * ) Notice: Subject to any disclaimer, the term of this patent is extended or adjusted under 35 U.S.C. 154(b) by 226 days.

(21) Appl. No.: 13/924,594

(22) Filed: Jun. 23, 2013

(65) Prior Publication Data

US 2014/0132239 A1 May 15, 2014

Related U.S. Application Data

(60) Provisional application No. 61/690,534, filed on Jun. 29, 2012.

(51) Int. Cl.

| | |
|---|---|
| ***G05F 3/16*** | (2006.01) |
| ***G05F 3/20*** | (2006.01) |
| ***G05F 1/46*** | (2006.01) |

(52) U.S. Cl.

CPC ..... *G05F 1/461* (2013.01)

(58) Field of Classification Search

USPC ..... 323/311–317

See application file for complete search history.

(56) References Cited

U.S. PATENT DOCUMENTS

| | | | | |
|---|---|---|---|---|
| 6,504,417 | B1 | 1/2003 | Cecchi et al. | |
| 6,798,182 | B2 * | 9/2004 | Charlon | 323/316 |
| 7,297,896 | B2 | 11/2007 | Biunno et al. | |
| 7,777,475 | B2 * | 8/2010 | Sperling et al. | 323/314 |
| 7,915,883 | B2 * | 3/2011 | Chida | 323/315 |
| 8,786,271 | B2 * | 7/2014 | Chang et al. | 323/313 |
| 8,836,314 | B2 * | 9/2014 | Zhu | 323/315 |
| 8,836,315 | B2 * | 9/2014 | Satoh et al. | 323/316 |
| 8,947,067 | B1 * | 2/2015 | Zarei | 323/313 |

OTHER PUBLICATIONS

Razavi, B., Design of Integrated Circuits for Optical Communications, McGraw-Hill, 2003.

Lee, T. H., The Design of CMOS Radio Frequency Integrated Circuits, Cambridge University Press, Dec. 2003.

Georgescu, B. A., Spiral Inductor Q-Enhancement Techniques, M. Sc. Thesis, Uni-versity of Calgary, May 2003.

Silvaco, Inductance Optimization using 3D Field Solver based on Design of Experi-ment Approach, http://www.silvaco.com/tech_lib_TCAD/simulationstandard/2006/feb/a1/a1.html.

K. Kang et al., Analysis of Frequency and Temperature Dependent Substrate Eddy Currents in On-Chip Spiral Inductors Using the Complex Image Method, IEEE Transac-tions on Magnetics, vol. 43, No. 7., Jul. 2007.

* cited by examiner

*Primary Examiner* — Adolf Berhane
*Assistant Examiner* — Gary Nash
(74) *Attorney, Agent, or Firm* — Michael J. Feigin, Esq.; Feigin & Associates, LLC

(57) ABSTRACT

A novel fully integrated adjustable DC current reference is developed. The reference current is set by the ratio of a DC voltage generated using a band-gap reference and a tuned resistor based on an inductor reference. An AC signal is necessary to develop a relationship between the resistor tuned and the inductor reference. A computation unit which could be designed as an analog circuit is necessary to compute the value of the resistor in relationship to the reference inductor. Classic circuits are used to develop and analyze the relationship between the reference inductor and the tunable resistor that sets the DC current reference. Results show that the value of the inductance is insensitive to process, voltage and temperature variations. Therefore, assuming the DC bandgap reference voltage is insensitive to changes in process, voltage and temperature variations, so is the DC current reference.

11 Claims, 3 Drawing Sheets

Fully Integrated DC Current Reference
Based on an Integrated Bogie Reference Inductor

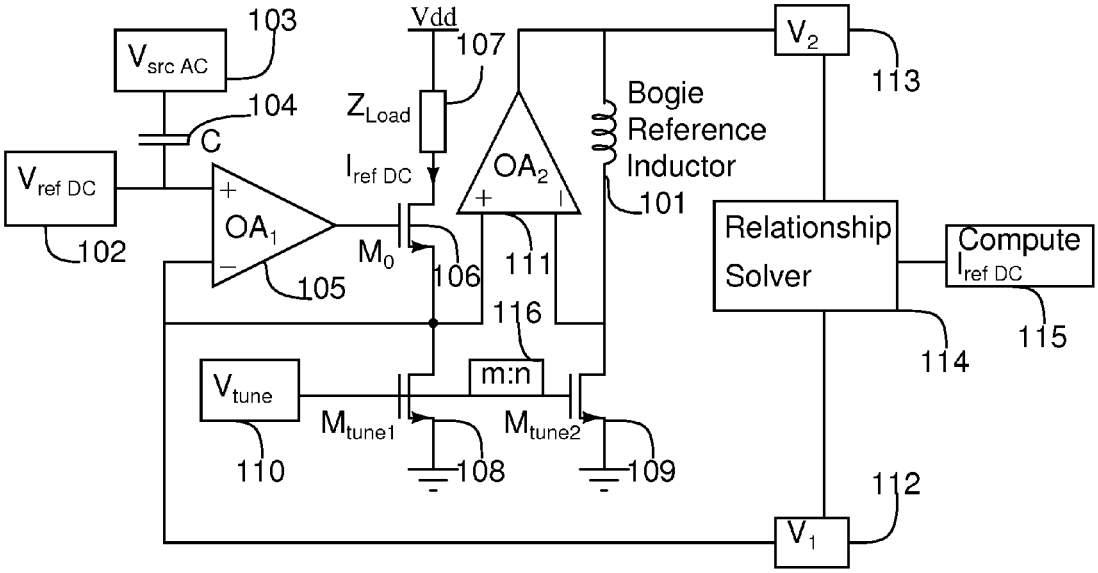
Figure 1. Fully Integrated DC Current Reference Based on an Integrated Bogie Reference Inductor

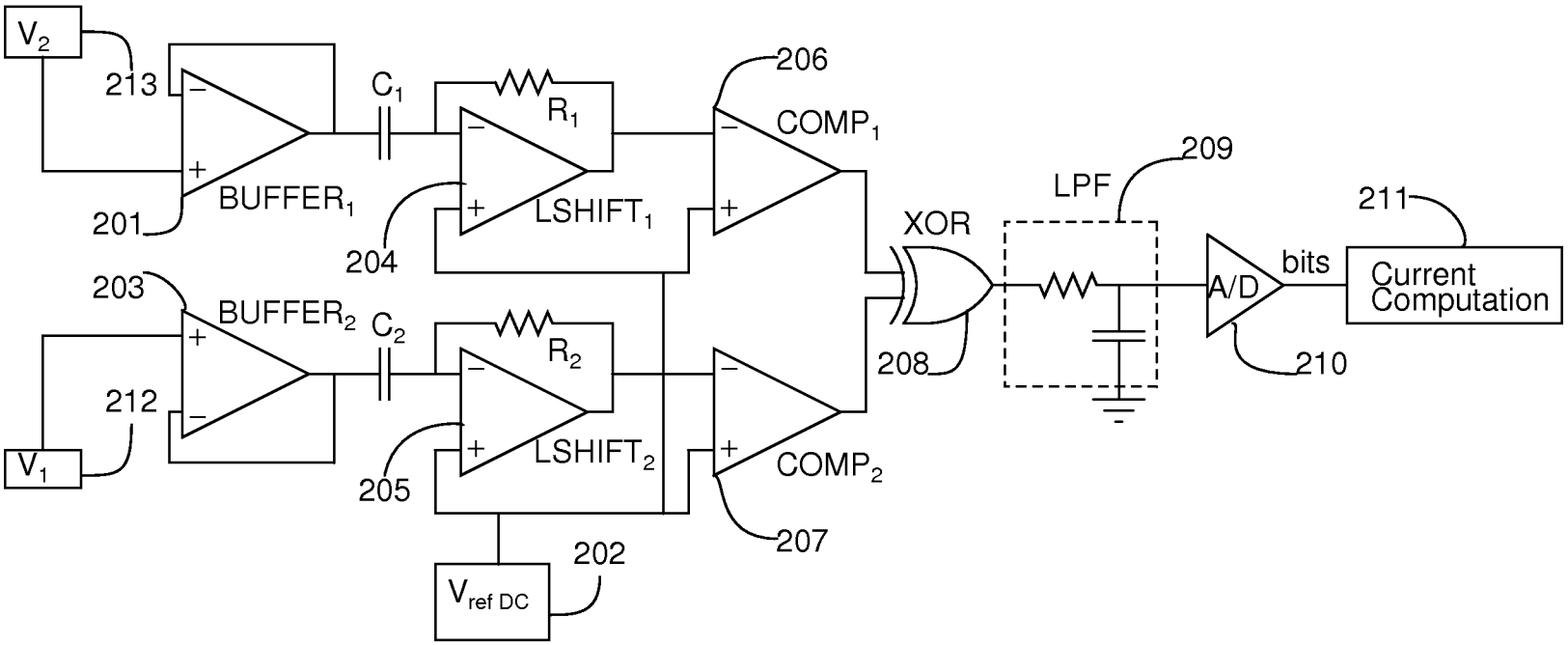
Figure 2. Relationship Solver Computing the Current Based on the Phase Difference Between $V_1$ and $V_2$

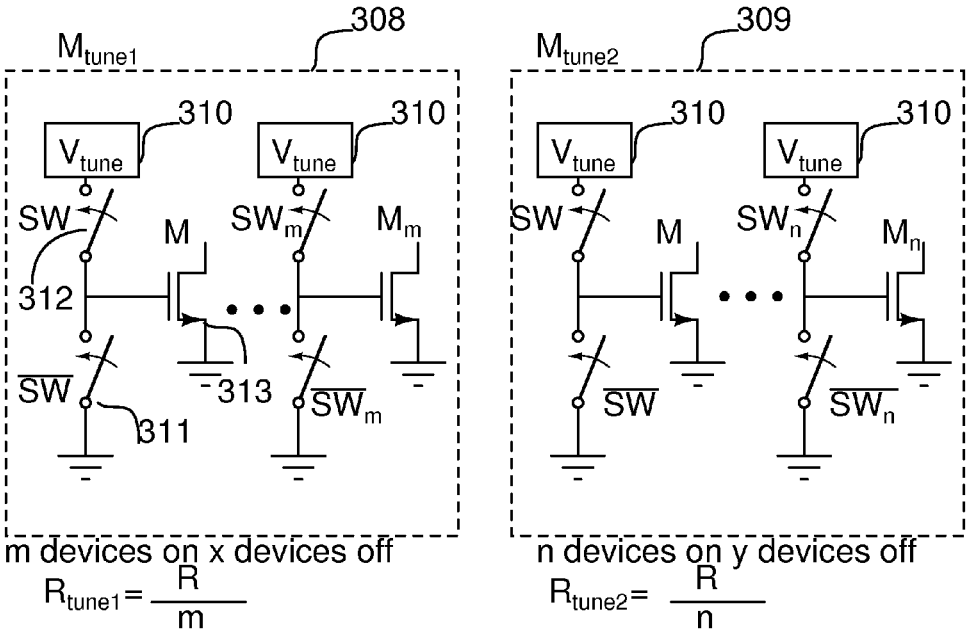
Figure 3. Adjustable Ratio Matching Circuit

FULLY INTEGRATED ADJUSTABLE DC CURRENT REFERENCE BASED ON AN INTEGRATED INDUCTOR REFERENCE

FIELD OF THE INVENTION

The disclosed technology relates generally to electrical circuitry and, more specifically, to the development of an adjustable DC current reference.

BACKGROUND OF THE DISCLOSED TECHNOLOGY

Significant efforts were made to develop an integrated DC voltage reference insensitive to Process, Voltage and Temperature (PVT) variations. The DC voltage references are usually based on the Silicon bandgap. To create a DC current reference insensitive to PVT one need in theory just an integrated resistor insensitive to PVT. Unfortunately, integrated resistors are very sensitive to process variations and they drift with temperature. Clearly post fabrication control is needed to adjust the value of such a resistor.

The option of trimming the resistor post-fabrication does not resolve the temperature drift problem and one can trim only before packaging so the value of the current reference cannot be tuned post-trimming. It is true that if temperature drift is not a concern, trimming is a simple and robust solution. Trimming is done usually based on an external resistor. Using an integrated inductor reference could simplify the trimming process.

The option of using a resistor component external to the integrated circuit to set the current has at least the following disadvantages:

The external resistor requires additional pads.

The external resistor requires additional space on the integrated circuit support board i.e. printed circuit board.

The external resistor generates noise or picks up noise from the board and requires decoupling capacitors.

The external resistor value will drift with temperature.

SUMMARY OF THE DISCLOSED TECHNOLOGY

The object of the present invention is to exploit the fact that the integrated inductance value is insensitive to PVT variations to create an adjustable DC current reference.

A novel fully integrated adjustable DC current reference is developed. The reference current is set by the ratio of a DC voltage generated using a band-gap reference and a tuned resistor based on an inductor reference. An AC signal is necessary to develop a relationship between the resistor tuned and the inductor reference. A computation unit which could be designed as an analog circuit is necessary to compute the value of the resistor in relationship to the reference inductor.

Classic circuits are used to develop and analyze the relationship between the reference inductor and the tunable resistor that sets the DC current reference. The fundamental novelty is the DC current reference is ultimately a function of the integrated inductance value and the DC bandgap reference voltage. According to published measured results, the value of the inductance is insensitive to process, voltage and temperature variations. Therefore, assuming the DC bandgap reference voltage is insensitive to changes in process, voltage and temperature variations, so is the DC current reference.

BRIEF DESCRIPTION OF THE DRAWINGS

FIG. 1 shows a fully integrated adjustable DC current reference based on an integrated bogie reference inductor of an embodiment of the disclosed technology.

FIG. 2 shows a relationship solver computing the current based on the phase difference between $V_1$ and $V_2$.

FIG. 3 shows an adjustable ratio matching circuit of an embodiment of the disclosed technology.

DETAILED DESCRIPTION OF EMBODIMENTS OF THE DISCLOSED TECHNOLOGY

To understand the operation of the circuit the insensitivity of inductance to PVT variations is first emphasized. The model of an on-chip inductor, which in its simplest form can be just a metal trace, is complex at high frequencies in the GHz range. However, at lower frequencies (e.g. 200 MHz) the capacitors may be ignored and the impedance of a small inductor (e.g. 1 nH) can be written as $Z_L = j\omega L_{Bogie} + R_{series}$. It is very important to note that only the inductance $L_{Bogie}$ is insensitive to PVT variations while $R_{series}$ is sensitive to PVT like any other on-chip resistor.

Embodiments of the disclosed technology will become clearer in view of the following description of the drawings.

The following arguments demonstrate that $L_{Bogie}$ is insensitive to PVT variations:

Theoretical formulas in Razavi [1], Lee [2], Georgescu [3] show small dependency of the metal trace thickness and strong dependency of the layout which does not vary significantly with PVT changes.

Simulations were described in the U.S. Provisional Application Ser. No. 61/690,534, and Silvaco [4] showing that changes of up to 20% in various process parameters (e.g. metal trace thickness) result in changes of 1% in inductance.

Measured results in Kang et al. [5] FIG. 10 show insensitivity of $L_{Bogie}$ to temperature variations especially at lower frequencies (e.g. 200 MHz).

Once the $L_{Bogie}$ insensitivity to PVT variations has been demonstrated the circuit in FIG. 1 the preferred embodiment can be explained.

The current through the load $Z_{Load}$ 107 is set as the ratio of $V_1$ 112 and the drain source resistance $R_{tune1}$ of the MOSFET in triode $M_{tune1}$ 108. $R_{tune1}$ is set using the voltage $V_{tune}$ 110. $M_O$ 106 is a current buffer.

Due to the operational amplifier $OA_1$ 105 the voltage $V_1$ 112 is composed of a DC component equal to $V_{ref\,DC}$ 102 added to a sinusoidal AC component of frequency ω due to 103 connected to the positive terminal of the operational amplifier through capacitor C 104. $V_{srcAC}$ 103 can and should be a sinusoidal signal generated by a crystal (e.g. 200 MHz). $V_{ref\,DC}$ 102 is a known constant voltage generated for example by a Silicon band-gap reference and designed to be insensitive to PVT variations. The following relationship holds:

$$V_1 = V_{refDC} + kV_{srcAC} \quad \text{(Eq. 1)}$$

where k is a coupling constant.

The following relationship holds characterizing the DC component of the reference current:

$$I_{refDC} = \frac{V_{refDC}}{R_{tune1}} \quad \text{(Eq. 2)}$$

The tuning resistor $R_{tune1}$ due to $M_{tune1}$ 108 is ratio matched to $R_{tune2}$ due to $M_{tune2}$ 109 using an adjustable ratio matching circuit 116. One can set in a digital fashion positive integers n and m such that: $R_{tune1} = R/m$, $R_{tune2} = R/n$ so one can set:

$$R_{tune1} = \frac{n}{m} R_{tune2} \quad \text{(Eq. 3)}$$

An example of an adjustable ratio matching circuit 116 to perform this task is shown in FIG. 3. The critical component of the system is the Bogie Reference Inductor 101 which is essential in generating a voltage $V_2$ 113 using operational amplifier $OA_2$ 111. The following relationship holds at frequency ω the frequency of operation of $V_{srcAC}$ 103 between the sinusoidal components of $V_2$ 113 and $V_1$ 112:

$$\frac{V_2}{V_1} = 1 + \frac{j\omega L_{Bogie} + R_{series}}{R_{tune2}} \quad \text{(Eq. 4)}$$

We can set $R_{tune1}$ which is tuned simultaneously with $R_{tune2}$ by using a relationship solver 114 between $V_2$ 113 and $V_1$ 112. The relationship solver 114 determines a relationship between $V_2$ 113 and $V_1$ 112. The result can be used to determine a relationship between $R_{tune1}$ and $j\omega L_{Bogie}$. An example relationship solver 114 which computes the phase difference between two sinusoidal voltages is shown in FIG. 2.

Computing the phases $\phi_1$ and $\phi_2$ respectively for two ratios $n_1/m_1$ and $n_2/m_2$ between $R_{tune1}$ and $R_{tune2}$ the following equations can be written:

$$\tan(\phi_1) = \frac{\omega L_{Bogie}}{R_{tune1}\frac{m_1}{n_1} + R_{series}} \quad \text{(Eq. 5)}$$

$$\tan(\phi_2) = \frac{\omega L_{Bogie}}{R_{tune1}\frac{m_2}{n_2} + R_{series}} \quad \text{(Eq. 6)}$$

$$R_{tune1} = \omega L_{Bogie} \frac{\frac{1}{\tan(\phi_1)} - \frac{1}{\tan(\phi_2)}}{\frac{m_1}{n_1} - \frac{m_2}{n_2}} \quad \text{(Eq. 7)}$$

If $V_{refDC}/R_{tune1} = I_{refDCdesired}$, the desired DC current then the tuning process has ended and the AC signal $V_{srcAC}$ 103 can be turned off else one needs to adjust $V_{tune}$ to decrease or increase $R_{tune1}$.

The relationship solver 114 in FIG. 1 is a phase detector described in FIG. 2. The input voltages in FIG. 2 $V_2$ 213 and $V_1$ 212 are the two sinusoidal input signals $V_2$ 113 and $V_1$ 112 in FIG. 1. Two buffers 201 and 203 protect the circuit from loading. Two differentiators 204 and 205 remove the effect of the DC difference. The comparators 206 and 207 transform the sinusoids into square waves. The phase difference between the two square waves is determined using for example a XOR gate 208 and a low pass filter 209. An analog to digital converter 210 converts the phase difference into a digital number. The current computation is done by a computation engine 211 using the following relationship derived from Eq. (2) and Eq. (7), $$I_{refDC} = \frac{V_{refDC}}{\omega L_{Bogie}} \cdot \frac{\frac{m_1}{n_1} - \frac{m_2}{n_2}}{\frac{1}{\tan(\phi_1)} - \frac{1}{\tan(\phi_2)}} \quad \text{(Eq. 8)}$$

The adjustable ratio matching circuit which controls the ratio of $R_{tune1}$ due to 108 to $R_{tune2}$ due to $M_{tune2}$ 109 is shown in FIG. 3. Each transistor $M_{tune1}$ 308 and 309 is composed of a number of identical unit devices M 313. In the case of $M_{tune1}$ 308 using the complementary switches S W 312 and S W 311 the gate is grounded for x unit devices and connected to $V_{tune}$ 310 for m unit devices to operate in triode. As a result: tune $$R_{tune1} = \frac{R}{m} \quad \text{(Eq. 9)}$$

where R is the triode drain source resistance of the unit transistor.

Similarly:

$$R_{tune2} = \frac{R}{n}. \quad \text{(Eq. 10)}$$

The integers m and n can be controlled digitally to set various matching ratios.

The factors that limit the precision of the DC current value which can be achieved using the method described are mismatch between components, DC offsets and finite gain of the operational amplifiers.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

What is claimed:

1. A fully integrated DC current reference comprising:

a) a band-gap voltage reference, b) a sinusoidal AC voltage source of known frequency which can be disabled, c) a voltage to current converter which sets a reference DC current value as a ratio of a first voltage equal to said bandgap voltage reference and a first tunable resistor, d) an adjustable ratio matching circuit which sets the ratio between said first tunable resistor and a second tunable resistor, e) an integrated Bogie reference inductor, f) a circuit network which generates a second voltage dependent of said first voltage, said second tunable resistor and said integrated Bogie reference inductor, g) a relationship solver which has the inputs said first voltage and said second voltage and generates an output dependent on the said second tunable resistor and the inductance of said integrated Bogie reference inductor, h) a computation engine which determines said reference DC current value based on a bandgap reference voltage value, the inductance of said integrated Bogie reference inductor, the ratios between said first inductor and said second inductor, and the output of the relationship solver.

2. The voltage to current converter of claim 1 further comprising:

a) a band-gap reference voltage as input, b) an operational amplifier operated with negative feedback, c) a transistor connected as a current buffer, d) a tunable resistor implemented as a MOSFET transistor in triode.

3. The adjustable ratio matching circuit of claim 1 implemented as a digital bank of gate switched transistors in triode further comprising:

a) two transistors each implemented as a plurality of unit transistors, b) complementary switches connected to the gate of each unit transistor allowing high impedance and tunable impedance modes of operation.

4. The circuit network of claim 1 implemented as a non-inverting operational amplifier further comprising:

a) a said first voltage at the non-inverting input, b) a said integrated Bogie reference inductor connected from the output to the inverting input, c) a said second tunable resistor connected from the inverting input to the negative supply, d) a said second voltage at the output.

5. The relationship solver of claim 1 implemented as a phase detector further comprising:

a) two sinusoidal input voltages, b) two buffer amplifiers to avoid loading, c) two differentiators amplifiers to eliminate a DC difference between said sinusoidal input voltages, d) two comparators to square said sinusoidal input voltages, e) a XOR gate to detect a phase difference between sine waves, f) a low pass filter to extract a DC value corresponding to the phase difference, g) an analog to digital converter to convert the phase difference into bits.

6. A method to set DC current of said fully integrated DC current reference of claim 1, wherein said DC current is set as a function of the inductance of said integrated Bogie reference inductor.

7. A fully integrated DC current reference comprising:

a) a band-gap voltage reference, b) a sinusoidal AC voltage source of known frequency, c) a voltage to current converter which sets a reference DC current value as a first voltage;

d) an adjustable ratio matching circuit which sets the ratio between a first tunable resistor and a second tunable resistor;

e) an intergrated Bogie reference inductor; and f) a circuit network which generates a second voltage dependent of said first voltage and said second tunable resistor.

8. The fully integrated DC current reference of claim 7, wherein said second voltage is dependent additionally on an integrated Bogie reference inductor.

9. The fully integrated DC current reference of claim 7, further comprising:

g) a relationship solver which has the inputs of said first voltage and said second voltage and generates an output dependent on the said second tunable resistor and the inductance of an integrated Bogie reference inductor.

10. The fully integrated DC current reference of claim 7, further comprising:

h) a computation engine which determines said reference DC current value based on a bandgap reference voltage value and the inductance of an integrated Bogie reference inductor.

11. The fully integrated DC current reference of claim 10 wherein said determination of said reference DC current value is based additionally on ratios between said first inductor and said second inductor, and the output of a relationship solver.

* * * * *